United States Patent [19]

Aberer

[11] 4,016,387

[45] Apr. 5, 1977

[54] SNAP TOGETHER SWITCH ASSEMBLY

[75] Inventor: James B. Aberer, Lake Winnebago, Mo.

[73] Assignee: Rival Manufacturing Company, Kansas City, Mo.

[22] Filed: June 9, 1975

[21] Appl. No.: 584,897

[52] U.S. Cl. ..... 200/303; 200/284; 200/11 R; 220/324

[51] Int. Cl.[2] ..... H01H 3/08

[58] Field of Search ... 220/4 B, 324, 326, 321–323; 200/303, 318, 320, 284, 155 R, 307, 275, 11 R

[56] References Cited

UNITED STATES PATENTS

| | | | |
|---|---|---|---|
| 1,738,140 | 12/1929 | Desperd | 200/303 |
| 2,572,651 | 10/1951 | Mucher | 200/307 |
| 2,874,338 | 2/1959 | Pease | 200/303 |
| 2,921,147 | 1/1960 | Hutt | 200/303 |
| 3,242,297 | 3/1966 | Piber | 200/303 |
| 3,286,070 | 11/1966 | Volker | 200/303 |
| 3,525,825 | 8/1970 | Allison | 200/303 |
| 3,612,335 | 10/1971 | Schurman | 220/324 |
| 3,676,630 | 7/1972 | Dennison | 200/303 |

*Primary Examiner*—Gerald P. Tolin
*Attorney, Agent, or Firm*—Lowe, Kokjer, Kircher, Wharton & Bowman

[57] ABSTRACT

A rotary type electrical switch includes one housing section having a plurality of lugs and another housing section having resilient brackets which snap into engagement with the lugs to assemble the housing. The stationary electrical contacts comprise leaf spring elements which are held in place within the housing by bridge members. A spider member electrically connects selected contacts in response to manipulation of a shaft on which the spider is carried.

A second embodiment eliminates the lugs and resilient brackets and holds the housing sections together with spring clips which surround portions of one housing section and engage shoulders of the other housing section.

3 Claims, 5 Drawing Figures

SNAP TOGETHER SWITCH ASSEMBLY

BACKGROUND AND SUMMARY OF THE INVENTION

This invention relates generally to electrical switches and deals more particularly with switch assemblies in which the components of the switch housing are connected in a snap fit.

Rotary type switches that accommodate a variety of settings are commonly used in many electrical appliances and similiar equipment. At present, the components of the switch housing are typically held together with screws or similar fastening elements which are difficult and time-consuming to install when assembling the switch. A further problem has been encountered in mounting the stationary electrical contacts within the switch housing. Since these contacts must be first secured at precise locations, their installation involves additional assembly difficulties and the overall cost of the switch is increased accordingly.

It is therefore an important object of the present invention to provide an improved and unique switch that may be quickly and easily assembled.

Another object of the invention is to provide a switch in which the switch housing is firmly held together over a long operating life and yet may be readily disassembled when desired.

A further object of the invention is to provide a switch having an improved means for securing the stationary contacts at precise locations within the housing.

A still further object of the invention is to provide a switch of the character described that may be easily mounted on a support panel or similar structure.

Yet another object of the invention is to provide a switch of the character described that is economical to produce, strongly constructed, and reliable in operation.

Other and further objects of the invention, together with the features of novelty appurtenant thereto, will appear in the course of the following description.

DETAILED DESCRIPTION OF THE INVENTION

In the accompanying drawing which forms a part of the specification and is to be read in conjunction therewith, and in which like reference numerals are employed to indicate like parts in the various views.

Figure 1:
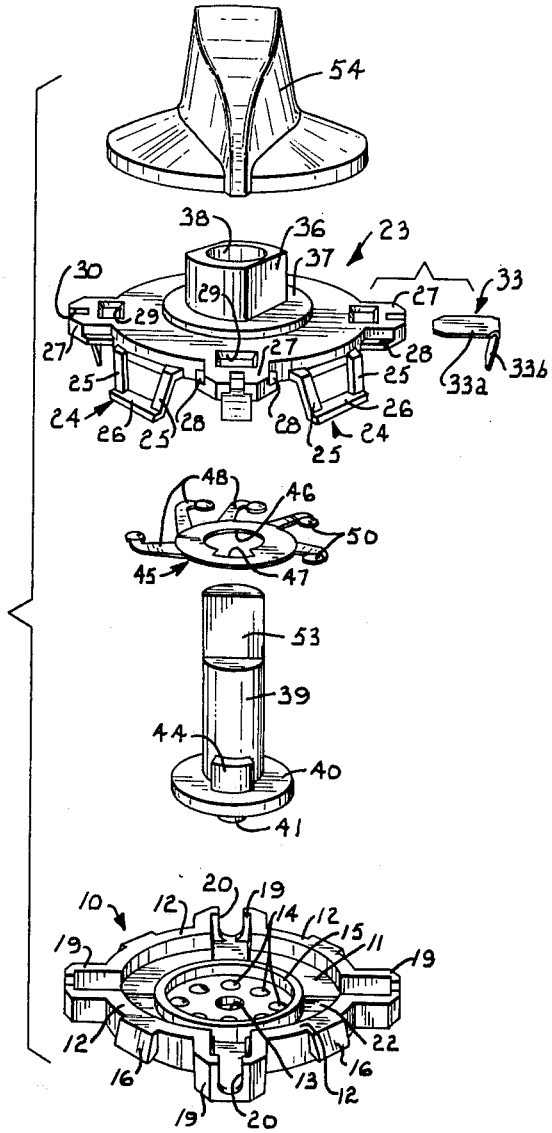
FIG. 1 is an exploded view illustrating the components of a switch assembly constructed according to the invention.

Referring now to the drawings and initially to FIG. 1, a switch assembly constructed according to the present invention includes a body member or casing 10 which houses the switch mechanism. Casing 10 is preferably molded of a durable plastic having good electrical insulation properties. A generally circular base plate 11 forms the bottom of casing 10, and four arcuate wall sections 12 extend upwardly from the periphery of the base plate. A small circular opening 13 is formed centrally through base plate 11 and has a plurality of convex bosses 14 extending therearound in a circular arrangement. An upstanding circular ridge 15 is located a short distance outwardly of bosses 14 and is concentric with opening 13.

Figure 4:
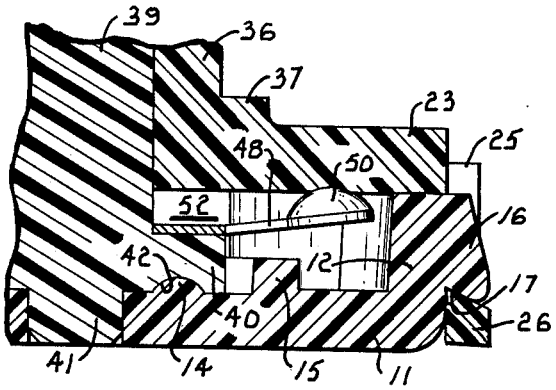
FIG. 4 is a fragmentary sectional view on an enlarged scale taken generally along line 4—4 of FIG. 2 in the direction of the arrows.

The exterior surface of each wall section 12 has an integral lug 16 formed thereon, with the four lugs being spaced equidistantly from one another at 90° intervals. With reference to FIG. 4 in particular, each lug 16 is tapered somewhat with its exterior surface slanting outwardly as it extends downwardly from the top of wall section 12. A substantially flat shoulder 17 is presented on the underside of each lug 16 and is smoothly rounded at its outer edge. Each shoulder 17 angles upwardly as it approaches wall section 12 such that the shoulders and wall sections join at an acute angle.

Figure 2:
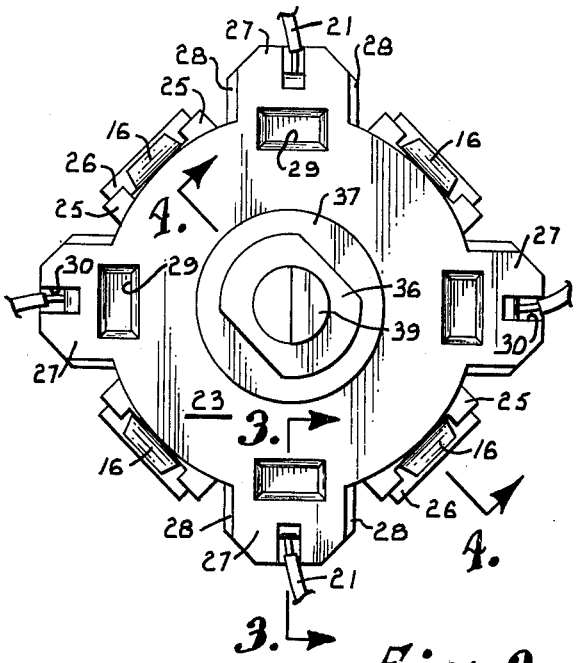
FIG. 2 is a top plan view of the switch assembly in its assembled condition, with the control knob removed for illustrative purposes.
Figure 3:
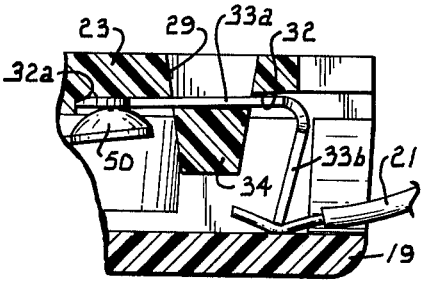
FIG. 3 is a fragmentary sectional view on an enlarged scale taken generally along line 3—3 of FIG. 2 in the direction of the arrows.

Referring again to FIG. 1, an electrical contact housing 19 is located between each pair of wall sections 12. The four contact housings 19 project outwardly from the periphery of casing 10 and are spaced from one another at 90° intervals. Each housing 19 includes parallel side walls which extend outwardly from wall sections 12 and a solid floor which extends between the bottom edges of the side walls. The outer end wall of each contact housing is provided with a slot 20 for receiving an insulated electrical wire 21 (FIGS. 2 and 3). Four shallow grooves 22 extend radially in base plate 11 from ridge 15 and into contact with housings 19.

A cover for casing 10 is generally designated by numeral 23 and is preferably molded of the same plastic as the casing. The body of the cover is of approximately the same size and shape as base plate 11. Four resilient loop elements 24 extend integrally from the periphery of cover 23 and are spaced equidistantly from one another at 90° intervals to conform to the spacings of lugs 16. Each loop element 24 includes a pair of spaced side straps 25 which extend downwardly and slightly outwardly from the periphery of the cover. Each pair of side straps 25 are interconnected at their bottom ends by a bar 26. The space presented between the side straps and above bar 26 is large enough to receive lug 16, while the generally flat upper surface of each bar 26 (see FIG. 4) is inclined at an angle substantially equal to the angle of the shoulders 17. Accordingly, the respective bars 26 and shoulders 17 are constructed to flatly engage one another, as best illustrated in FIG. 4. It is noted that loop elements 24 are resilient and can thus be displaced outwardly somewhat, although their resiliency urges them inwardly in a direction opposite to the displacement.

Referring to FIGS. 1 and 2 in particular, four projecting plate portions 27 are integral with cover 23 and project outwardly from the periphery thereof. Plates 27 are equidistant from one another —t 90° intervals and are of a suitable size and shape to overlie the respective contact housings 19. The upper side portions of each plate 27 are recessed to form shoulders 28 that extend along the opposite side edges of each plate. A rectangular opening 29 is formed through each plate 27, and the outer end of each plate has a notch 30 formed therein.

Referring now to FIG. 3, a shallow channel 32 is recessed in the underside of each plate 28 to receive a stationary contact 33 which is constructed of any suitable electrically conducting metal. Each contact 33 comprises a flat base 33*a* and a leg 33*b* which extends at an acute angle from one end of base 33*a*. Each contact 33 acts in the manner of the leaf spring in that leg 33*b* may be displaced or bent toward base 33*a*, while the bent leg is urged away from the base by spring action. The connecting portion between base 33*a* and leg 33*b* is necked down somewhat to better accommodate the spring action. The end of base 33*a* opposite from leg 33*b* is slightly tapered at its side edges, and the inward end of channel 32 is similarly tapered to conform with the configuration of base 33*a*. Base 33*a* lies within channel 32 and is limited in its inward movement therein by engagement with the end wall 32*a* of the channel.

A transverse bar or bridge 34 spans the width of each channel 32 at an intermediate portion thereof. The opposite ends of each bridge 34 join integrally with the underside of plate 27, and the bridges cooperate with channel 32 to define thin slots in which contacts 33 are closely received and retained by the bridges. The inner end wall 32*a* of channel 32 restrains contact 33 against inward movement in the channel, while bridge 34 prevents the contact from dropping out of the channel.

Referring again to FIG. 1, the upper surface of cover 33 is provided with a central hub 36 which is reinforced at its lower end by a thin circular boss 37. Hub 36 is generally cylindrical, although its opposite sides are flattened. A cylindrical bore 38 extends centrally through hub 36 and cover 23. A shaft 39 is received in bore 38, and the shaft carries a disc 40 at its bottom end. Disc 40 seats against base plate 11 within ridge 15, while a short stub 41 extends below the disc and is received in opening 13 to help maintain shaft 39 in the proper alignment.

A plurality of concave indentations 42 (FIG. 4) are formed in the underside of disc 40 in a circular pattern corresponding to the arrangement of bosses 14. Bosses 14 fit rather closely within indentations 42 and thereby tend to maintain shaft 39 in the particular rotative position in which the shaft is set. However, shaft 39 may be rotated to move the indentations into engagement with different bosses in order to establish another rotative position of the shaft.

An arcuate projection 44 (FIG. 1) extends upwardly from disc 40 along a portion of the surface of shaft 39. A spider member 45 constructed of electrically conductive metal has a central opening 46 which permits the spider to be installed on shaft 39. A cut out portion 47 adjacent opening 46 is fit closely over projection 44 in order to key spider 45 to shaft 39.

Spider 45 comprises a thin central plate from which five arms 48 extend generally radially. Four of the arms 48 are spaced equidistantly from one another, while the fifth arm is spaced remotely from the other arms. Each of the arms has a curved outer end which is bent slightly upwardly, as best illustrated in FIG. 4. A convex tip 50 projects upwardly from the extreme outer end of each arm 48. The upward bend of the curved portion of each arm assures that tip 50 will bear upwardly against the stationary contacts 33, as illustrated in FIG. 3.

A counterbore 52 (FIG. 4) is formed in the underside of cover 23. The size of counterbore 52 is sufficient to receive projection 44 and permit same to rotate therein. A stop member (not shown) of approximately the same size and shape as projection 44 is located in the counterbore area to engage projection 44 and thereby limit the rotation of shaft 39 to approximately 90°.

The outer end of shaft 39 which projects above hub 36 is provided with a flat side 53. A control knob 54 has an opening (not shown) in its underside that matches the configuration of the end of shaft 30 so that the knob can be fit on the end of the shaft and can be rotated to effect rotation of the shaft and connected spider.

The switch is assembled by first sliding the four contacts 33 such that their bases 33*a* are received in the channels 32 and above bridges 34, which prevent the contacts from falling out of the channels. After spider 45 has been installed on shaft 39, the shaft is inserted through bore 38 until projection 44 is located within counterbore 52. The connection of cover 23 to casing 10 is accomplished by aligning loop elements 24 with lugs 16 and pressing the cover onto the top of the casing. The inclined outer surfaces of lugs 16 act against bars 26 to cam the resilient loop elements 24 outwardly, and when the bars have reached shoulders 17, the loop elements are pressed back inwardly to position bars 26 against shoulders 17, as shown in FIG. 4. The connection thus established between bars 26 and shoulders 17 maintains cover 23 firmly in place and prevents any relative movement between the cover and casing. It is pointed out that straps 25 bear against the flat opposite sides of lugs 16 so that rotation of the cover with respect to the casing is precluded. The acute angle of shoulder 17, in cooperation with the matching angle of the upper surface of bar 26, assures that the shoulders and bars will not inadvertently disengage from one another. However, the resilient loop elements 24 may be forced outwardly to separate bars 26 from shoulders 17 in order to permit the switch to be disassembled.

As the cover is being installed on the casing, contacts 33 enter the respective contact housings 19, and the ends of legs 33*b* are moved against the exposed ends of wires 21. (The associated wires may be inserted after switch is completed and used as an end product.) As best illustrated in FIG. 3, each leg 33*b* is bent toward its base 33*a*, and the spring action of the bent leg urges it away from the base such that wire 21 is tightly engaged between the edge of leg 33*b* and the floor of contact housing 19. In this manner, wires 21 are firmly held in place in electrical connection with the respective contacts 33. In addition, the end wall of housing 19 bears against the outer end of contact 33 to cooperate with bridge 34 and the inner wall 32*a* of channel 32 in retaining the contact in a stationary position.

It is contemplated that the switch assembly will be mounted to a panel or the like (not shown). Accordingly, an aperture is formed in the panel, and hub 36 is inserted through the aperture. Since hub 36 is plastic, a self-threading metal nut (not shown) may be applied to the hub with the nut forming its own threads as it is advanced onto the hub. Once the nut has been threaded sufficiently to mount the switch on the panel, knob 54 is installed on the end of shaft 39 and may thereafter be manipulated to rotate shaft 39 and thus position spider 35 as desired.

In operation, one of the wires 21 will be the lead-in wire from a power source (not shown), and the other three wires will apply the power, serving, for example, as heater wires in an electrical appliance or the like. With knob 54 positioned to establish connection between one of the spider arms and the contact 33 which engages the lead-in wire, electrical current will be supplied through spider 35 to whichever of the other contacts 33 are engaged by other arms of the spider. Accordingly, current can be supplied to any or all of the heater wires, depending on the particular position of spider 35. It is noted that the close fit between bosses 14 and indentation 42 assures that the shaft 39 will not inadvertently rotate once it has been moved to a desired setting.

Figure 5:
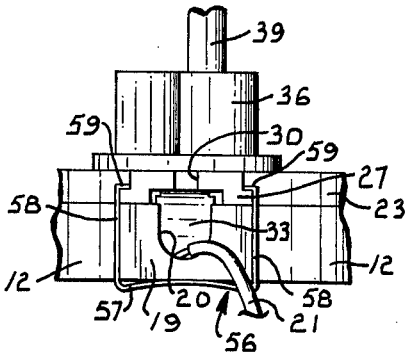
FIG. 5 is a fragmentary elevational view illustrating a second embodiment of the invention which connects the switch housing by an alternative means.

Turning now to FIG. 5, a second embodiment of the switch assembly is constructed as previously described, except that an alternative means for attaching cover 23 to casing 10 is provided. In the second embodiment, lugs 16 and loop elements 24 are eliminated, and four generally U-shaped metal spring clips 56 are utilized to secure the cover on top of the casing. Each clip 56 includes a slightly arched bottom web 57 which is slightly greater in length than the width of the contact housings 19. A pair of upstanding legs 58 extend approximately perpendicularly from the opposite ends of web 57. The length of each leg 58 is slightly greater than the height of contact housings 19. An inturned flange is bent inwardly at a right angle from the top end of each leg 58. Flanges 59 are of a size to flatly engage shoulders 28 and thereby rigidly secure cover 23 to casing 10.

The assembly of the second embodiment is accomplished by installing contacts 33, spider 45, and shaft 39 in the manner previously related. After wires 21 have been inserted into the contact housings 19, as previously described, cover 23 is placed on top of casing 10, and contacts 33 are thereby engaged against the exposed ends of wires 21. The four clips 56 are then applied by pressing flanges 59 away from one another to permit web 57 to be inserted beneath contact housing 19 with legs 58 disposed on opposite sides thereof. When flanges 59 are released, they spring inwardly and come into engagement with shoulders 28, as shown in FIG. 5. The arch in web 57 assures that the flanges are held tightly against the shoulders. Web 57 bears against the underside of the contact housing and legs 58 bear against its opposite side walls such that the cover and casing are rigidly connected and prevented from moving relative to one another. Since flanges 59 are recessed below the upper surface of cover 23, they are not likely to be inadvertently disengaged from shoulders 28.

From the foregoing, it will be seen that this invention is one well adapted to attain all of the ends and objects herein set forth, together with other advantages which are obvious and which are inherent to the structure.

It will be understood that certain features and subcombinations are of utility and may be employed without reference to other features and subcombinations.

As many possible embodiments may be made of the invention without departing from the scope thereof, it is to be understood that all matter herein set forth or shown in the accompanying drawing is to be interpreted as illustrative and not in a limiting sense.

Having thus described my invention, I claim:

1. An electric switch assembly comprising:

a first housing section having a plurality of spaced projections extending laterally therefrom, each projection having a pair of opposite sides and an underside;

a second housing section connected to said first housing section and cooperating therewith in defining an enclosure, said second housing section presenting a plurality of pairs of shoulders overlying the respective projections;

a plurality of generally U-shaped clips each having a web extending along said underside and a pair of legs extending from said web along said opposite sides, each clip further including a pair of flanges projecting from said legs and substantially flatly engaging the respective pairs of shoulders to rigidly connect said first and second housing sections together;

a plurality of electrical contacts comprised of current conducting material, one of said contacts being adapted for connection to a power source;

means securing said contacts in stationary positions within said enclosure; and a switch actuator having current conducting means located within said enclosure, said switch actuator being accessible for adjustment exteriorly of said enclosure to establish electrical connection between selected contacts through said current conducting means.

2. The invention of claim 1, wherein said second housing section has an upper surface and said shoulders are each recessed below said upper surface.

3. An electric switch assembly comprising:

a pair of housing sections connected with one another and cooperating to present an enclosure;

a plurality of current conducting electrical contacts, each contact having a substantially flat base portion and a spring leg portion adapted for connection with a conductor;

a plurality of recessed channels presented in one of said housing sections, said channels closely receiving the representative base portions of said contacts therein with the leg portions of said contacts projecting out of said channels;

a bridge member for each contact, said bridge members depending from said one housing section and spanning the respective channels to cooperate therewith in retaining said base portions in stationary positions within said channels; and a switch actuator having current conducting means located within said enclosure, said switch actuator being accessible for adjustment exteriorly of said enclosure to establish electrical connection between selected contacts through said current conducting means.

* * * * *